US010997907B2

(12) United States Patent
Baek et al.

(10) Patent No.: US 10,997,907 B2
(45) Date of Patent: May 4, 2021

(54) DISPLAY APPARATUS AND CONTROL METHOD THEREOF

(71) Applicant: SAMSUNG ELECTRONICS CO., LTD., Suwon-si (KR)

(72) Inventors: Seung Jin Baek, Suwon-si (KR); Ho Sik Sohn, Seoul (KR); Kil Soo Jung, Osan-si (KR); Oh Jae Kwon, Suwon-si (KR); Ho Young Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/650,689

(22) PCT Filed: Sep. 21, 2018

(86) PCT No.: PCT/KR2018/011342
§ 371 (c)(1),
(2) Date: Mar. 25, 2020

(87) PCT Pub. No.: WO2019/066443
PCT Pub. Date: Apr. 4, 2019

(65) Prior Publication Data

US 2020/0320927 A1 Oct. 8, 2020

(30) Foreign Application Priority Data

Sep. 26, 2017 (KR) ..... 10-2017-0124296

(51) Int. Cl.
*G09G 3/3225* (2016.01)

(52) U.S. Cl.
CPC ... *G09G 3/3225* (2013.01); *G09G 2300/0452* (2013.01); *G09G 2320/0233* (2013.01); *G09G 2320/0693* (2013.01); *G09G 2360/16* (2013.01)

(58) Field of Classification Search
CPC ... G09G 2320/0693; G09G 2320/0233; G09G 2320/0242; G09G 2320/0666
See application file for complete search history.

(56) References Cited

U.S. PATENT DOCUMENTS 6,973,210 B1 * 12/2005 Platt ..... G09G 3/20 382/162
2006/0221030 A1 * 10/2006 Shih ..... G09G 3/3611 345/88

(Continued)

FOREIGN PATENT DOCUMENTS

JP 2005-173429 A 6/2005
JP 2007-324665 A 12/2007

(Continued)

OTHER PUBLICATIONS

International Search Report (PCT/ISA/210) dated Jan. 23, 2019, issued by the International Searching Authority in counterpart International Application No. PCT/KR2018/011342.

*Primary Examiner* — Sepehr Azari
(74) *Attorney, Agent, or Firm* — Sughrue Mion, PLLC

(57) ABSTRACT

The present invention provides a display apparatus that improves the uniformity of luminance among a plurality of pixels and improves chromaticity by recalibrating artifacts of a display image recognized by a visual sensation even after calibration is performed, and a method of controlling the same. The display apparatus may include a display panel; a communication circuitry configured to receive an initial calibration coefficient value of a first pixel and at least one second pixel except for the first pixel of the display panel; and a controller configured to compare luminance of the first pixel and the second pixel based on the initial calibration coefficient value, to modify the initial calibration (Continued)

coefficient value based on the comparison result, and to control the display panel based on the modified calibration coefficient value.

20 Claims, 12 Drawing Sheets

(56) References Cited

U.S. PATENT DOCUMENTS

2007/0195110 A1* 8/2007 Nagase ..... G09G 3/2007 345/611
2009/0051627 A1* 2/2009 Ihata ..... G09G 3/3208 345/76
2011/0254759 A1* 10/2011 Mori ..... G09G 3/3607 345/88
2014/0043369 A1* 2/2014 Albrecht ..... G09G 5/02 345/690
2015/0213771 A1* 7/2015 Ohnishi ..... G01J 3/46 345/88
2015/0294642 A1* 10/2015 Kurokawa ..... G09G 5/02 345/690
2015/0332643 A1* 11/2015 Higashi ..... G09G 5/243 345/694
2016/0027369 A1* 1/2016 Guo ..... G09G 3/2074 345/694
2016/0035263 A1* 2/2016 Guo ..... G09G 3/2003 345/593
2016/0247445 A1* 8/2016 Zhang ..... G09G 3/2003
2018/0040271 A1* 2/2018 Jung ..... G06F 3/1446
2018/0225075 A1* 8/2018 Park ..... G09G 3/3233

FOREIGN PATENT DOCUMENTS

KR 10-2007-0031757 A 3/2007
KR 10-2007-0093708 A 9/2007
KR 10-1374648 B1 3/2014

* cited by examiner

| ① | Coeff R | Coeff G | Coeff B |
|---|---|---|---|
| G | 0.01 | 0.86 | 0.08 |

FIG. 9

155

COEFFICIENT MODIFIER

| | Coeff R | Coeff G | Coeff B |
|---|---|---|---|
| G | 0.01 | 0.86 | 0.08 |

| | Coeff R | Coeff G | Coeff B |
|---|---|---|---|
| G | 0.20 | 0.86 | 0.08 |

| | Coeff R | Coeff G | Coeff B |
|---|---|---|---|
| G | 0.20 | 0.80 | 0.08 |

DISPLAY APPARATUS AND CONTROL METHOD THEREOF

TECHNICAL FIELD

The present disclosure relates to a display apparatus for reducing artifacts, and a method of controlling the display apparatus.

BACKGROUND ART

Display apparatuses refer to output apparatuses displaying visual information converted from obtained or stored electrical information to users and have been widely used in various application fields such as individual homes or places of business.

The display apparatuses may be monitor devices connected to personal computers or server computers, portable computer devices, navigation devices, televisions (TVs), Internet Protocol televisions (IPTVs), smart phones, tablet personal computers (PCs), personal digital assistants (PDAs), or portable terminals such as cellular phones. In addition, the display apparatuses may be various display apparatuses used to play advertisements or movies, or various types of audio/video systems in the industrial field.

The display apparatus may have a difference in luminance and chromaticity, that is, light output of each pixel in a reproduced image due to electrical, physical, and optical characteristics. For example, even if a same input source is applied to the display apparatus, each pixel that emits light on a display panel may emit light having different chromaticity values.

A process of reducing this difference is called calibration, and the calibration is for the uniformity of light emitting diodes (LEDs).

On the other hand, even after the calibration is performed, artifact holes observed by a human eye are generated in an output image of the display apparatus. The phenomenon is caused by the difference in coefficient values of Red/Green/Blue between the calibrated pixel and the surrounding pixels, which is a kind of optical illusion observed by the human eye.

Technical Problem

The present invention provides a display apparatus that improves the uniformity of luminance among a plurality of pixels and improves chromaticity by recalibrating artifacts of a display image recognized by a visual sensation even after calibration is performed, and a method of controlling the same.

Technical Solution

An aspect of the disclosure provides a display apparatus including: a display panel; a communication circuitry configured to receive an initial calibration coefficient value of a first pixel and at least one second pixel except for the first pixel of the display panel; and a controller configured to compare luminance of the first pixel and the second pixel based on the initial calibration coefficient value, to modify the initial calibration coefficient value based on the comparison result, and to control the display panel based on the modified calibration coefficient value.

The first pixel and the second pixel each comprise sub-pixels including three colors. The communication circuitry may be configured to receive the initial calibration coefficient value for at least one of the three colors.

The controller may be configured to compare the luminance of the first pixel and the second pixel based on the initial calibration coefficient values of a second sub-pixel except for a first sub-pixel including a maximum value of the initial calibration coefficient value.

The controller may be configured to modify at least one of the initial calibration coefficient value of the first sub-pixel and the initial calibration coefficient value of the second sub-pixel based on the comparison result.

The controller may be configured to modify the initial calibration coefficient value by decreasing the initial calibration coefficient value of the first sub-pixel and increasing the initial calibration coefficient value of the second sub-pixel based on a reference value that is a reference of the comparison result.

The controller may be configured to modify the initial calibration coefficient value of the first pixel when a difference between the luminance of the second sub-pixel among the first pixels and the luminance of the second sub-pixel among the second pixels exceeds a preset reference value.

The luminance of the second pixel may include an average value of luminance of a plurality of the second pixels arranged around the first pixel.

The controller may be configured to generate a gate control signal for controlling the display panel based on the modified calibration coefficient value.

The controller may be configured to modify the initial calibration coefficient value of the first pixel based on the luminance of the second pixel calculated based on the initial calibration coefficient value of the second pixel and measurement data received by the communication circuitry.

The measurement data may include at least one of luminance, chromaticity and sensitivity.

Another aspect of the disclosure provides a method of controlling a display apparatus including: receiving an initial calibration coefficient value of a first pixel of a display panel and at least one second pixel except for the first pixel; comparing luminance of the first pixel and the second pixel based on the initial calibration coefficient value; modifying the initial calibration coefficient value based on the comparison result; and controlling the display panel based on the modified calibration coefficient value.

The first pixel and the second pixel each comprise sub-pixels including three colors. The receiving may include receiving the initial calibration coefficient value for at least one of the three colors.

The comparing may include comparing the luminance of the first pixel and the second pixel based on the initial calibration coefficient values of a second sub-pixel except for a first sub-pixel including a maximum value of the initial calibration coefficient value.

The modifying may include modifying at least one of the initial calibration coefficient value of the first sub-pixel and the initial calibration coefficient value of the second sub-pixel based on the comparison result.

The modifying may include modifying the initial calibration coefficient value by decreasing the initial calibration coefficient value of the first sub-pixel and increasing the initial calibration coefficient value of the second sub-pixel based on a reference value that is a reference of the comparison result.

The modifying may include modifying the initial calibration coefficient value of the first pixel when a difference between the luminance of the second sub-pixel among the first pixels and the luminance of the second sub-pixel among the second pixels exceeds a preset reference value.

The luminance of the second pixel may include an average value of luminance of a plurality of the second pixels arranged around the first pixel.

The controlling may include generating a gate control signal for controlling the display panel based on the modified calibration coefficient value.

The modifying may include modifying the initial calibration coefficient value of the first pixel based on the luminance of the second pixel calculated based on the initial calibration coefficient value of the second pixel and measurement data received by a communication circuitry.

The measurement data may include at least one of luminance, chromaticity and sensitivity.

Advantageous Effects

According to an aspect of an embodiment, a display apparatus and a method of controlling the same recalibrates artifacts of a display image recognized by a visual sensation even after calibration is performed, thereby improving the uniformity of luminance among a plurality of pixels and improving chromaticity.

DESCRIPTION OF DRAWINGS

FIGS. 7 to 9 are views for describing an operation according to an embodiment.

MODES OF THE INVENTION

Figure 1:
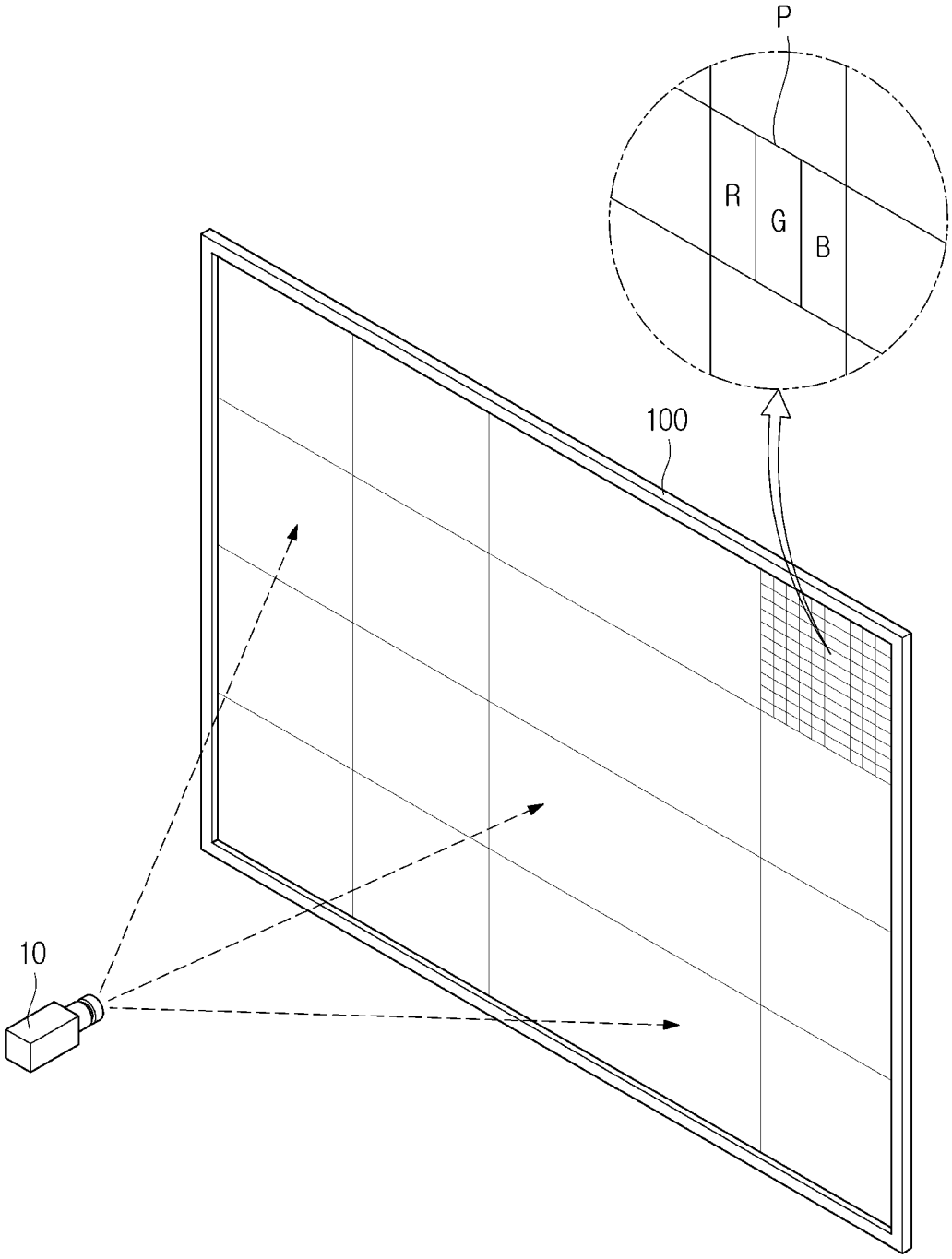
FIG. 1 is a view for describing calibration of a display panel.

Embodiments and features as described and illustrated in the present disclosure are only preferred examples, and various modifications thereof may also fall within the scope of the disclosure.

The terminology used herein is for the purpose of describing particular embodiments only and is not intended to limit the present disclosure.

Particularly, the singular forms as used herein are intended to include the plural forms as well, unless the context clearly indicates otherwise.

It will be further understood that the terms "comprises" and/or "comprising," when used in this specification, indicate the presence of stated features, integers, steps, operations, elements, and/or components, but do not preclude the presence or addition of one or more other features, integers, steps, operations, elements, components, and/or groups thereof.

The terms including ordinal numbers such as "first" and "second" may be used to explain various components, but the components are not limited by the terms. The terms are only for the purpose of distinguishing one component from another.

Furthermore, the terms, such as "~part," "~block," "~member," "~module," etc., may refer to a unit of handling at least one function or operation. For example, the terms may refer to at least one process handled by hardware such as a field-programmable gate array (FPGA)/application specific integrated circuit (ASIC), etc., software stored in a memory, or a processor.

Reference numerals used in operations are provided for convenience of description, without describing the order of the operations, and the operations can be executed in an order different from the stated order unless a specific order is definitely specified in the context.

Embodiments of the present disclosure will now be described in detail with reference to the accompanying drawings.

FIG. 1 is a view for describing calibration of a display panel.

Referring to FIG. 1, calibration of a display panel may use a display apparatus 100 and a measuring apparatus 10 for measuring an image output from a display apparatus 100.

The display apparatus 100 is an apparatus capable of processing an image signal received from the outside (e.g., external image source) and visually displaying the processed image. In the following description, the display apparatus 100 may be implemented as a TV, but the embodiment of the display apparatus 100 is not limited thereto. For example, the display apparatus 100 may be implemented as a monitor of a computer, or may be included in a navigation terminal device or various portable terminal devices. Here, the portable terminal devices may be a desktop computer, a laptop computer, a smartphone, a tablet personal computer (PC), a wearable computing device, or a personal digital assistant (PDA).

A plurality of pixels, i.e., pixels P, are formed on a screen of the display apparatus 100, that is, the screen, and an image to be displayed on the screen may be formed by light emitted from the pixels P.

Here, the pixels P may refer to a dot, which is the smallest unit of the image. Accordingly, the screen is composed of a set of pixels. Each of the plurality of pixels P may emit light with various brightness and various colors.

For example, in the screen such as a light emitting diode (LED) display, a single pixel consists of three sub-pixels.

The sub-pixels are composed of a red sub-pixel R, a green sub-pixel G and a blue sub-pixel B, that is, three primary colors of light. That is, the single pixel may represent every color with the three primary colors of light, Red R, Green G, and Blue B.

That is, the display apparatus 100 selectively or sequentially outputs red, green, and blue light in the single pixel P. As a result, a single image is displayed on the screen by combining the light output from the single pixel P.

Meanwhile, the red sub-pixel R emits red light of various levels of brightness; the green sub-pixel G emits green light of various levels of brightness; and the blue sub-pixel B emits blue light of various levels of brightness. The red light has a wavelength ranging from about 620 nanometers (nm, which is one in a billion) to about 750 nm; the green light has a wavelength ranging from about 495 nm to about 570 nm; and the blue light has a wavelength ranging from about 450 nm to about 495 nm.

For example, each of the pixels P of the display apparatus 100 may be controlled to output the green G light having a wavelength selected from a range of 495 nm to 570 nm.

However, even though the same current flows due to the electrical, physical, and optical characteristics generated during the manufacturing of the display apparatus 100, the wavelengths of the green light output from each of the pixels P may not be uniform.

Therefore, the display apparatus 100 may perform the calibration to uniformly output the light, and the measuring apparatus 10 may determine a calibration coefficient by measuring and analyzing the light output from each of the pixels P.

Conventionally, the calibration coefficient determined by the measuring apparatus 10 is directly applied to the display apparatus 100.

Figure 2:
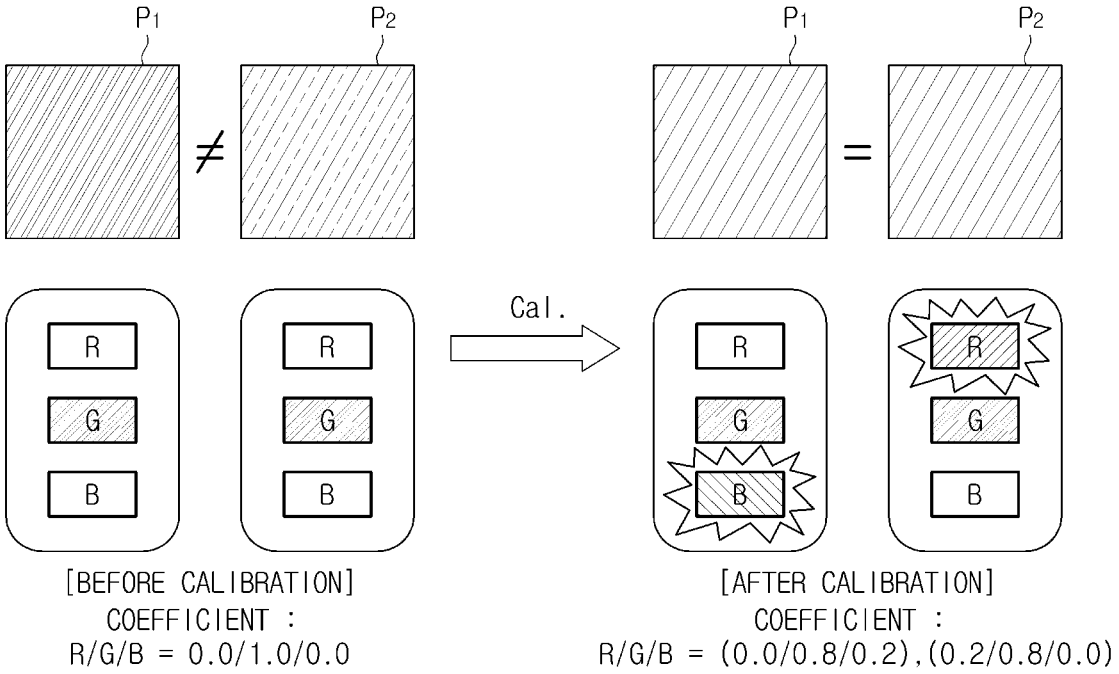
FIG. 2 is a view for describing an initial calibration coefficient value according to an embodiment.

FIG. 2 is a view for describing an initial calibration coefficient value according to an embodiment.

Referring to FIG. 2, two pixels P1 and P2 of the display apparatus 100 before the calibration may output green light by applying an R/G/B coefficient of 0.0/1.0/0.0. However, the two pixels P1 and P2 of the display apparatus 100 may output green light having different chromaticities.

When the calibration is performed on the two pixels P1 and P2 of the display apparatus 100, the pixel P1 may increase the coefficient value of the green sub-pixel G to reduce the chromaticity of the green, and the pixel P2 may increase the coefficient value of the red sub-pixel R to increase the chromaticity of the red.

That is, after the calibration is performed, the calibration coefficient value for the R/G/B of the pixel P1 may be 0.0/0.8/0.2, and the calibration coefficient value for the R/G/B of the pixel P2 may be 0.2/0.8/0.0.

The calibration coefficient value determined by the measuring apparatus 10 may be transmitted to the display apparatus 100.

The display apparatus 100 according to an embodiment may calibrate the calibration coefficient value again. Hereinafter, the calibration coefficient value received by the display apparatus 100 may be referred to as an initial calibration coefficient value.

Figure 3:
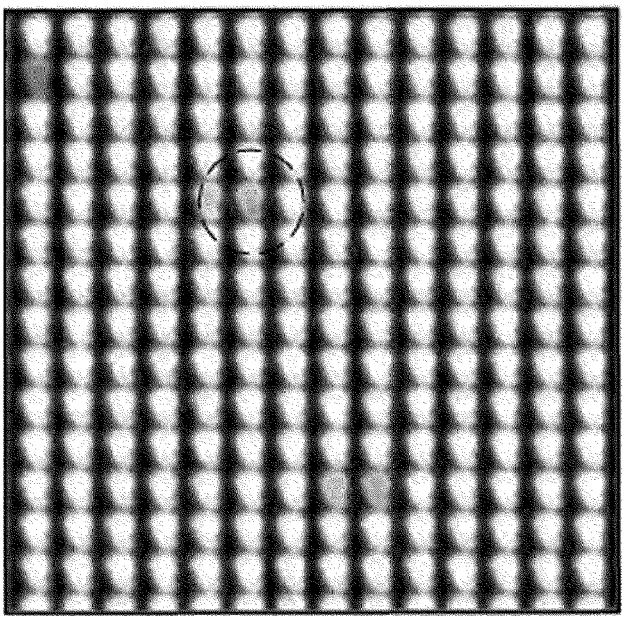
FIG. 3 is a view for describing artifacts of a display image output after applying an initial calibration coefficient value.

FIG. 3 is a view for describing artifacts of a display image output after applying an initial calibration coefficient value.

By applying the initial calibration coefficient value described above in FIG. 2, each of the pixels P of the display apparatus 100 may output the green light. However, as illustrated in FIG. 3, the human eye may recognize a millet-shaped artifact hole instead of uniformly calibrated green light.

The problem may be caused by an error of a colorimeter itself, which is one component of the measuring apparatus 10, and may be caused by a visual illusion of human visual sensation due to interference between each pixel because the coefficient value of other sub-pixels except for the green sub-pixel in the display apparatus 100, that is, red or blue sub-pixels approaches zero.

The display apparatus 100 may calibrate the initial calibration coefficient value in order to reduce artifacts that may occur as illustrated in FIG. 3 by the initial calibration coefficient value.

Figure 4:
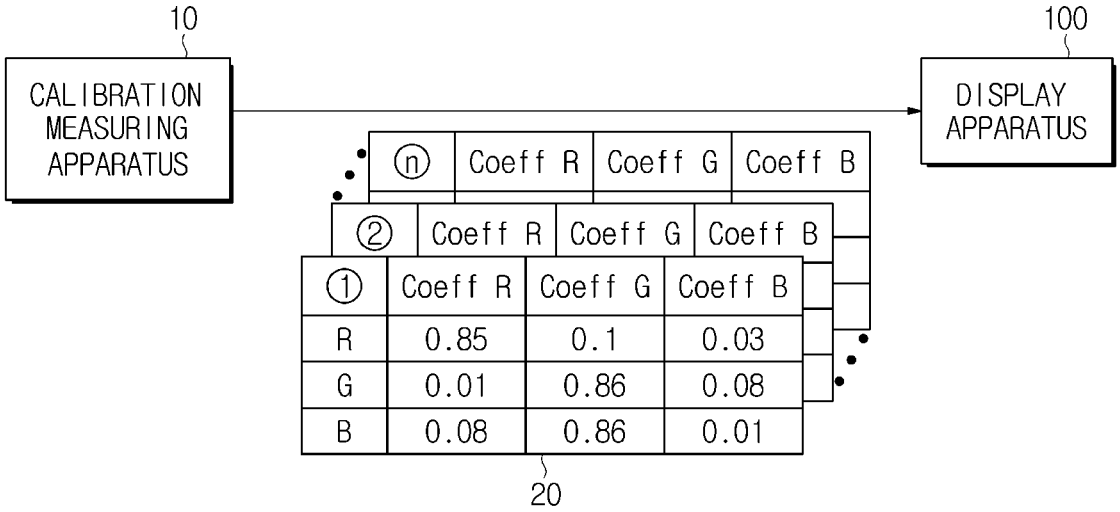
FIG. 4 is a view illustrating a measuring apparatus and a display apparatus according to an embodiment.
Figure 5:
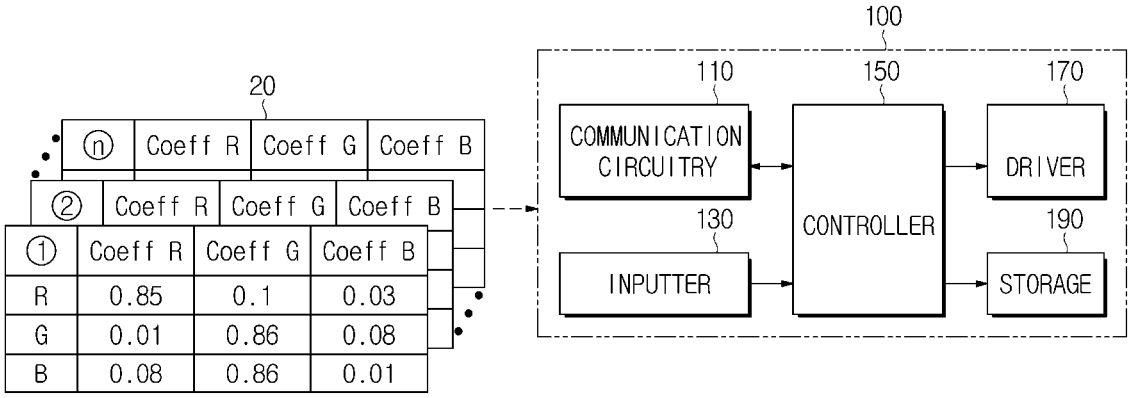
FIGS. 5 and 6 are control block diagrams of the display apparatus.
Figure 6:
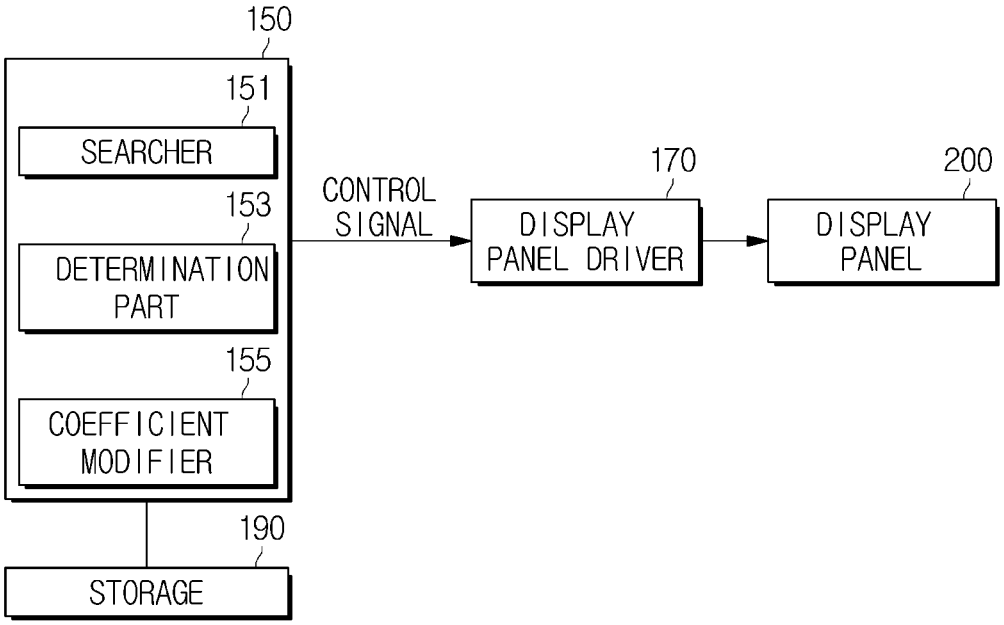

FIG. 4 is a view illustrating a measuring apparatus and a display apparatus according to an embodiment, and FIGS. 5 and 6 are control block diagrams of the display apparatus.

Referring to FIG. 4, the measuring apparatus 10, which has performed the calibration, may transmit a determined initial calibration coefficient value 20 to the display apparatus 100.

The initial calibration coefficient value 20 may include coefficient values of sub-pixels according to each color, and the coefficient values of all the pixels included in the display apparatus 100 may be transmitted.

Referring to FIG. 5, the display apparatus 100 may receive the initial calibration coefficient value.

The display apparatus 100 may include a communication circuitry 110 for receiving the initial calibration coefficient value, an inputter 130 for receiving a user's input command, and a driver 170 for driving a display panel 200 to emit light by applying the calibrated calibration coefficient value, a storage 190 for storing data such as the received initial calibration coefficient value, and a controller 150 for controlling the above-described configuration.

In detail, the communication circuitry 110 may include a communication module for connecting the display apparatus 100 to the outside. In more detail, the communication circuitry 110 may transmit and receive data with other electronic devices external to the display apparatus 100, and may also receive the user's input command through a remote control device.

In the display apparatus 100, the communication circuitry 110 may receive the initial calibration coefficient value 20 transmitted by the measuring apparatus 10, and may transmit the initial calibration coefficient value 20 to the controller 150.

Meanwhile, the communication module included in the communication circuitry 110 may include at least one of a short-range communication module, a wired communication module, and a wireless communication module.

The short-range communication module may include various short-range communication modules for transmitting and receiving signals within a short range over a wireless communication network, such as a Bluetooth module, an infrared communication module, a radio frequency identification (RFID) communication module, a wireless local access network (WLAN) communication module, a near field communication (NFC) module, a Zigbee communication module, etc.

The wired communication module may include not only one of the various wired communication modules, such as a local area network (LAN) module, a wide area network (WAN) module, or a value added network (VAN) module, but also one of various cable communication modules, such as a universal serial bus (USB), a high definition multimedia interface (HDMI), a digital visual interface (DVI), recommended standard (RS) 232, a power cable, or a plain old telephone service (POTS).

The wireless communication module may include a wireless fidelity (WiFi) module, a wireless broadband (WiBro) module, and/or any wireless communication module for supporting various wireless communication schemes, such as a global system for a mobile communication (GSM) module, a code division multiple access (CDMA) module, a wideband code division multiple access (WCDMA) module, a universal mobile telecommunications system (UMTS), a time division multiple access (TDMA) module, a long-term evolution (LTE) module, etc.

The wireless communication module may include a wireless communication interface including an antenna and a transmitter for transmitting a wireless signal. The wireless communication module may further include a signal conversion module for converting a digital control signal received from the measuring apparatus 10 through the wireless communication interface to an analog wireless signal.

The inputter 130 may receive a control command input by the user of the display apparatus 100 and transmit the control command to the controller 150. In addition, the inputter 130 may receive the initial calibration coefficient value directly input by the user instead of the communication circuitry 110 and transmit the initial calibration coefficient value to the controller 150.

The inputter 130 may include hardware devices such as various buttons, switches, keyboards, a mouse, track-balls, or the like. In addition, the inputter 130 may include a graphical user interface (GUI) such as a touch pad for the user input, that is, a software device. The touch pad may be implemented as a touch screen panel (TSP) to form a mutual layer structure with the display panel 200.

The controller 150 may be implemented with a memory storing an algorithm to control operation of the components in the display apparatus 100 or data about a program that implements the algorithm, and a processor carrying out the aforementioned operation using the data stored in the memory. The memory and the processor may be implemented in separate chips. Alternatively, the memory and the processor may be implemented in a single chip.

The controller 150 may calculate luminance emitted by each pixel by using the initial calibration coefficient value 20 transmitted by the communication circuitry 110 and measurement data transmitted by the measuring apparatus 10.

The luminance calculated at each pixel may refer to luminance emitted by three sub-pixels. The controller 150 may select a sub-pixel (hereinafter, referred to as 'second sub-pixel') except for a sub-pixel (hereinafter, referred to as 'first sub-pixel') whose calculated luminance values are at the maximum.

The controller 150 may compare the luminance of the selected second sub-pixel with the luminance of the second sub-pixel included in the surrounding pixel, and may determine whether artifacts occur.

When the difference between the pixel and the surrounding pixel exceeds a preset reference value, the controller 150 may modify the initial calibration coefficient value and control the driver 170 based on the modified calibration coefficient value.

Referring to FIG. 6, a series of operations of the controller 150 may be classified into a control block of a searcher 151 for searching for pixels from which the artifacts can be generated, a determination part 153 for determining a luminance difference using a reference value, and a coefficient modifier 155 for modifying the initial calibration coefficient value.

However, the classification for describing the operation of the present disclosure, and it may be implemented by a series of control methods through the algorithm implemented in the controller 150.

The driver 170 may control the display panel 200 illustrated in FIG. 6.

The display panel 200 does not need a backlight and may be implemented as an organic light emitting diode (OLED) based on a fluorescent organic compound that emits itself.

In detail, the display panel 200 may include a circuit (not shown) for driving the OLED, and the circuit may include a thin film transistor and a capacitor. When the controller 150 transmits a control signal based on the modified initial calibration coefficient value to the driver 170, the driver 170 may control the thin film transistor to the display panel 200 to control a driving current bled supplied to the OLED. Through this, the display panel 200 may output an image with reduced artifacts that can be recognized by visual sensation.

Meanwhile, the control of the display panel 200 and the driver 170 described above is not necessarily limited to the display apparatus 100 implemented as an OLED light emitting device, but may be applied to various display panels 200 that generate artifacts that can be recognized as visual sensations through calibration coefficient values. The storage 190 may store the received initial calibration coefficient values and store programs and data necessary for the operation of the controller 150 and other components.

The storage 190 may be implemented with at least one of a non-volatile memory device, such as Read Only Memory (ROM), Programmable ROM (PROM), Erasable Programmable ROM (EPROM), and Electrically Erasable Programmable ROM (EEPROM); a volatile memory device, such as Random Access Memory (RAM); or a storage medium, such as Hard Disk Drive (HDD) and Compact Disk (CD) ROM, without being limited thereto.

The storage 190 may be the memory implemented as a chip separate from the processor such as the controller 150, and may be implemented as the single chip with the processor.

Meanwhile, the display apparatus 100 may include other components in addition to the above-described components, but is not limited to the above-described embodiment.

Figure 7:
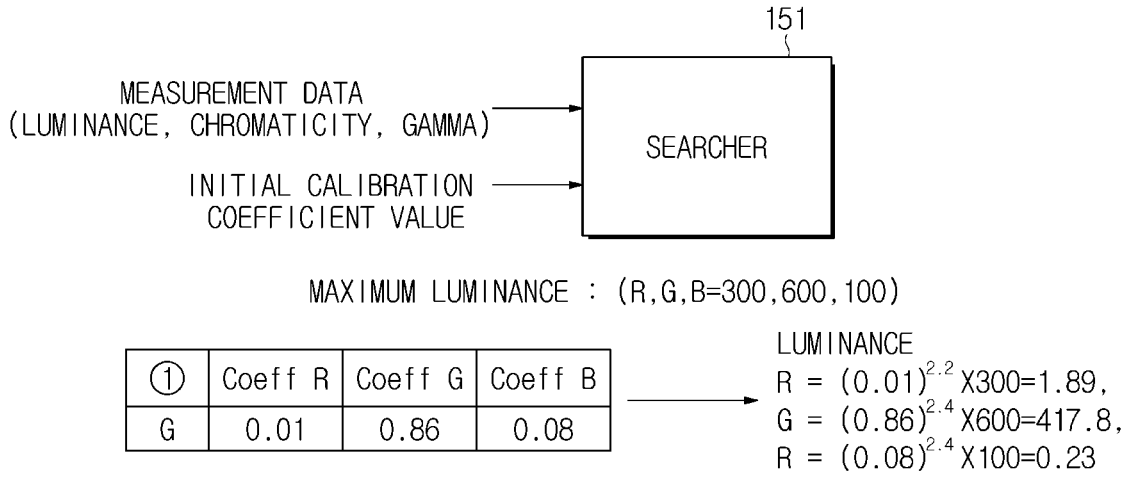
Figure 8:
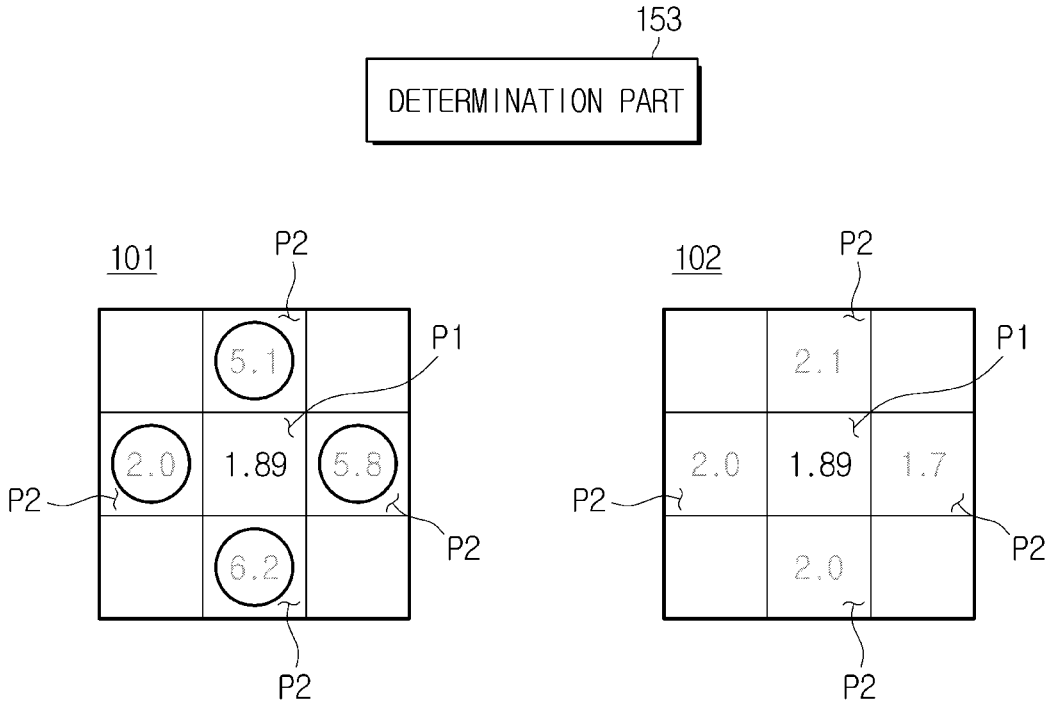
Figure 10:
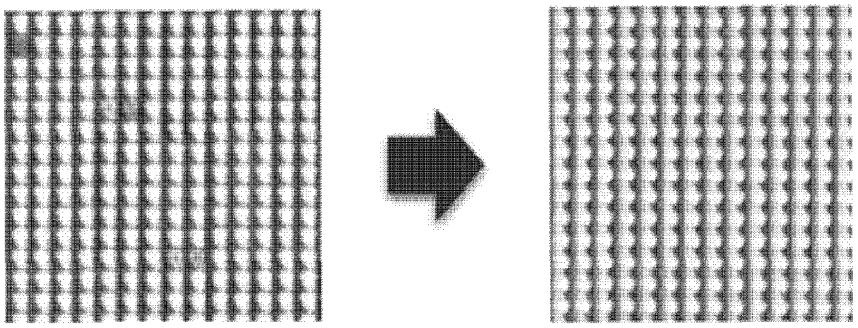
FIG. 10 is an example of a display image with reduced artifacts.

FIGS. 7 to 9 are views for describing an operation according to an embodiment, and FIG. 10 is an example of a display image with reduced artifacts.

Referring to FIG. 7, the searcher 151 of the controller 150 may search for pixels in which the artifacts may occur due to the visual sensation.

In detail, the searcher 151 may receive the measurement data and the initial calibration coefficient values from the measuring apparatus 10 to calculate the luminance of a pixel for a color having a constant chromaticity.

First, the searcher 151 may select one color having chromaticity of a predetermined size, and select a main pixel (hereinafter, referred to as 'first pixel') that affects the selected color. In the following description, green is illustrated as a selection color as an example.

The measurement data may include at least one of luminance, chromaticity, and gamma, and the luminance of the measurement data may include a maximum luminance of the pixel P for each color. In the embodiment of FIG. 7, the maximum luminance for the green color may exemplify that R, G, and B is 300, 600, and 100.

The searcher 151 may extract the initial calibration coefficient values for the green color, that is, 0.01, 0.86, and 0.08 from the received initial coefficient calibration values, and may calculate the luminance of the sub-pixels included in the first pixel using the maximum luminance included in the measurement data to determine the sub-pixels included in the first pixel.

Using the initial calibration coefficient value and the maximum luminance in the embodiment of FIG. 7, the searcher 151 may calculate luminance as 1.89 nt for the red sub-pixel, 417.8 nt for the green sub-pixel, and 0.23 nt for the blue sub-pixel in the first pixel.

The searcher 151 may calculate the luminance of the same green color in the pixels except for the first pixel as in the method calculated in the first pixel.

The searcher 151 may transmit the calculated luminance to the determination part 153.

Referring to FIG. 8, the determination part 153 may compare the luminance of the surrounding pixels (hereinafter, referred to as 'second pixel P2') of the first pixel P1 through the calculated luminance.

In detail, the determination part 153 may calculate an average value of luminance calculated in the second pixel P2 by a preset range. Thereafter, the determination part 153 may compare the difference between the calculated average value and the luminance of the first pixel P1 with a preset reference value.

The preset reference value may vary according to various conditions such as the size of the display apparatus 100 and whether or not the phenomenon of artifacts with respect to the color occurs, and may be changed by the user.

A left display panel 101 of FIG. 8 may be an embodiment in which the difference between the average value of luminance 1.89 nt of the first pixel P1 and luminance 5.1 nt, 5.8 nt, 6.2 nt, and 2.0 nt of the surrounding second pixel P2 of the first pixel P1 exceeds the reference value. A right display panel 102 may be an embodiment in which the luminance difference between the first pixel and the second pixel does not exceed the reference value.

The determination part 153 may compare the luminance of one pixel with the surrounding pixels to determine whether to change the initial coefficient calibration value. That is, in FIG. 8, the determination part 153 may modify the initial calibration coefficient value of the first pixel P1 with respect to the left display panel 101.

When the first pixel is selected according to the determination of the determination part 153, the coefficient modifier 155 may modify the initial calibration coefficient value 20 of the first pixel as illustrated in FIG. 9.

In detail, the coefficient modifier 155 may determine the sub-pixel to be modified in the first pixel P1.

As described above with reference to FIGS. 7 and 8, the initial calibration coefficient value for the green color has a maximum value of 0.86 for the green sub-pixel (hereinafter, referred to as 'first sub-pixel'). Through this, the coefficient modifier 155 may select the red sub-pixel (hereinafter, referred to as 'second sub-pixel') having a minimum coefficient value of 0.01 as the sub-pixel that causes artifacts.

The coefficient modifier 155 may increase the coefficient value of the second sub-pixel selected to represent luminance corresponding to the aforementioned reference value. In FIG. 9, the calibration coefficient value of the red sub-pixel is modified from 0.01 to 0.20.

In addition, the coefficient modifier 155 may reduce the coefficient value of the first sub-pixel by the increased luminance based on the coefficient value modified in the second sub-pixel. Through this, the coefficient modifier 155 may modify final luminance of the first pixel to be equal to the luminance of the surrounding second pixel.

The display apparatus 100 may reduce artifacts recognized by visual sensation of humans.

As illustrated in FIG. 10, when the initial calibration coefficient value is applied to the green color having a constant chromaticity, an artifact having a narrow rice shape is formed as illustrated on the left side. However, when the modified calibration coefficient value is applied, the display may reduce artifacts as illustrated on the right side of FIG. 10.

Figure 11:
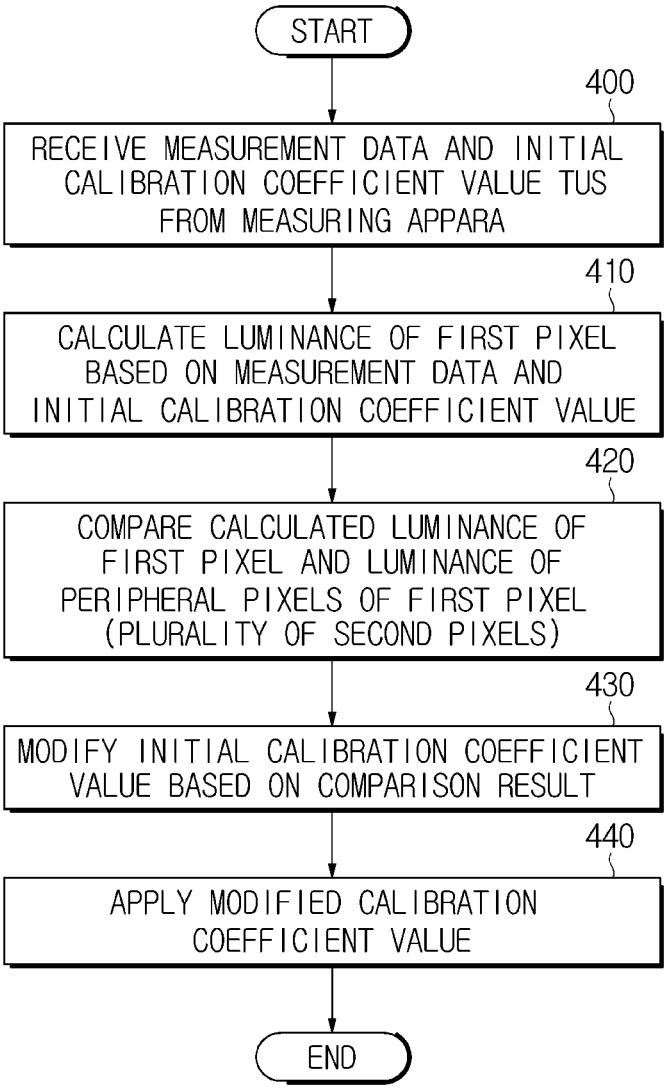
FIG. 11 is a flowchart of a control method according to an embodiment of the present disclosure.
Figure 12:
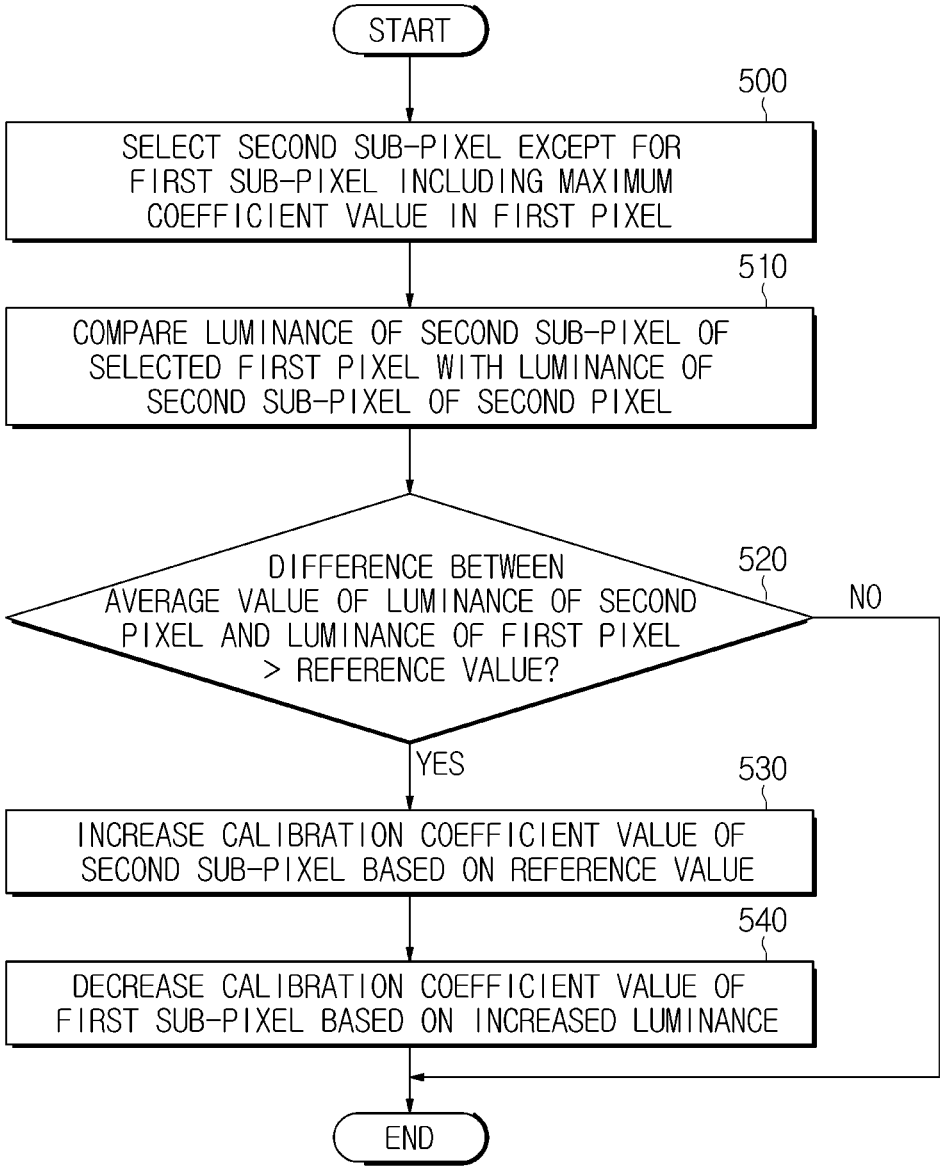
FIG. 12 is a flowchart for describing an operation of a controller in FIG. 11 in detail.

FIG. 11 is a flowchart of a control method according to an embodiment of the present disclosure, and FIG. 12 is a flowchart for describing an operation of a controller in FIG. 11 in detail.

Referring to FIG. 11, the display apparatus 100 may receive the measurement data and the initial calibration coefficient value from the measuring apparatus 10 (400).

The measurement data may further include the chromaticity and gamma while including the luminance, and may include various other measurement data. In addition, the initial calibration coefficient value may include the coefficient value for the sub-pixel of each pixel for each color.

The display apparatus 100, in detail, and the controller 150 may calculate the luminance of the first pixel based on the measurement data and the initial calibration coefficient value (410).

As described with reference to FIG. 7, a method of calculating the luminance may calculate the maximum luminance included in the measurement data based on the coefficient value for the sub-pixel of the first pixel.

Thereafter, the controller 150 may compare the calculated luminance of the first pixel and the luminance of the peripheral pixels of the first pixel, that is, the plurality of second pixels (420).

In detail, the controller 150 may compare the luminance of the sub-pixel (second sub-pixel) including the coefficient value that is the minimum with respect to the selected color with the luminance of the same sub-pixel of the surrounding pixel.

A comparison method may compare the luminance of the first sub-pixel with the luminance average value of the second sub-pixel included in the plurality of second pixels, and may determine whether the difference exceeds a preset reference value.

Here, the range and reference value of the surrounding pixel may be preset and may be variously changed.

Based on the comparison result, the controller 150 may modify the initial calibration coefficient value (430).

The comparison result may be determined as to whether the difference value exceeds the reference value, and may mean that the calibration coefficient value of the first pixel is modified based on the reference value.

When the initial calibration coefficient value is modified, the controller 150 may apply the modified calibration coefficient value (440).

In detail, the controller 150 may control the driver 170 based on the modified calibration coefficient value, and the driver 170 may drive the display panel 200 through a driving signal. Through this, the display apparatus 100 according to the embodiment may output an image having reduced artifacts.

Referring to FIG. 12, a control method of the controller 150 will be described in detail.

First, the controller 150 may select the second sub-pixel except for the first sub-pixel including the maximum coefficient value in the first pixel (500).

The selected second sub-pixel may be the sub-pixel causing the artifact, and may be the sub-pixel having the lowest coefficient value among the three sub-pixels.

For example, when the coefficient value for outputting green is applied, the red and blue coefficient values of the remaining sub-pixels are relatively lower than the green coefficient value. In some pixels, the red or blue coefficient value is almost zero, and thus the difference between the surrounding pixels occurs, and the difference may cause the artifact caused by visual sensation.

Accordingly, the controller 150 may determine whether there is a risk of causing the artifact by selecting a single second sub-pixel among the first pixels.

When the controller 150 selects the second sub-pixel of the first pixel and the first pixel included in the display panel 200, the controller 150 may compare the luminance of the pixels around the first pixel, that is, the luminance of the second pixel and the first pixel (510).

As mentioned in FIG. 11, particularly, the controller 150 may calculate the difference in luminance calculated at the second sub-pixel of each of the first pixel and the second pixel, and may determine whether the difference exceeds the preset reference value (520).

When the difference between the average value of luminance of the second pixel and the first pixel luminance exceeds the reference value, the controller 150 may increase the calibration coefficient value of the second sub-pixel based on the reference value (530).

The calibration coefficient value that is incremented in the second sub-pixel is the coefficient value of the first pixel.

In addition, the controller 150 may decrease the calibration coefficient value of the first sub-pixel in order to uniformly match the luminance of the first pixel with the surrounding pixels by the increased calibration coefficient value (540).

When the difference between the average value of the luminance of the second pixel and the first pixel luminance does not exceed the reference value, the controller 150 may determine that the artifact is not formed, and may search for another pixel or apply the initial calibration coefficient value to the display panel 200 without modifying the initial calibration coefficient value.

The invention claimed is:

1. A display apparatus comprising:

a display panel;

a communication circuitry configured to receive an initial calibration coefficient value of a first pixel and at least one second pixel except for the first pixel of the display panel; and a controller configured to compare luminance of the first pixel and the second pixel based on the initial calibration coefficient value, to modify the initial calibration coefficient value based on the comparison result, and to control the display panel based on the modified calibration coefficient value.

2. The display apparatus according to claim 1, wherein the first pixel and the second pixel each comprise sub-pixels including three colors, and wherein the communication circuitry is configured to receive the initial calibration coefficient value for at least one of the three colors.

3. The display apparatus according to claim 2, wherein the controller is configured to compare the luminance of the first pixel and the second pixel based on the initial calibration coefficient values of a second sub-pixel except for a first sub-pixel including a maximum value of the initial calibration coefficient value.

4. The display apparatus according to claim 3, wherein the controller is configured to modify at least one of the initial calibration coefficient value of the first sub-pixel and the initial calibration coefficient value of the second sub-pixel.

5. The display apparatus according to claim 4, wherein the controller is configured to modify the initial calibration coefficient value by decreasing the initial calibration coefficient value of the first sub-pixel and increasing the initial calibration coefficient value of the second sub-pixel based on a reference value that is a reference of the comparison result.

6. The display apparatus according to claim 3, wherein the controller is configured to modify the initial calibration coefficient value of the first pixel when a difference between the luminance of the second sub-pixel among the first pixels and the luminance of the second sub-pixel among the second pixels exceeds a preset reference value.

7. The display apparatus according to claim 1, wherein the luminance of the second pixel comprises an average value of luminance of a plurality of the second pixels arranged around the first pixel.

8. The display apparatus according to claim 1, wherein the controller is configured to generate a gate control signal for controlling the display panel based on the modified calibration coefficient value.

9. The display apparatus according to claim 1, wherein the controller is configured to modify the initial calibration coefficient value of the first pixel based on the luminance of the second pixel calculated based on the initial calibration coefficient value of the second pixel and measurement data received by the communication circuitry.

10. The display apparatus according to claim 9, wherein the measurement data comprises at least one of luminance, chromaticity and sensitivity.

11. A method of controlling a display apparatus comprising:

receiving an initial calibration coefficient value of a first pixel of a display panel and at least one second pixel except for the first pixel;

comparing luminance of the first pixel and the second pixel based on the initial calibration coefficient value;

modifying the initial calibration coefficient value based on the comparison result; and controlling the display panel based on the modified calibration coefficient value.

12. The method according to claim 11, wherein the first pixel and the second pixel each comprise sub-pixels including three colors, and wherein the receiving comprises:

receiving the initial calibration coefficient value for at least one of the three colors.

13. The method according to claim 12, wherein the comparing comprises:

comparing the luminance of the first pixel and the second pixel based on the initial calibration coefficient values of a second sub-pixel except for a first sub-pixel including a maximum value of the initial calibration coefficient value.

14. The method according to claim 13, wherein the modifying comprises:

modifying at least one of the initial calibration coefficient value of the first sub-pixel and the initial calibration coefficient value of the second sub-pixel based on the comparison result.

15. The method according to claim 14, wherein the modifying comprises:

modifying the initial calibration coefficient value by decreasing the initial calibration coefficient value of the first sub-pixel and increasing the initial calibration coefficient value of the second sub-pixel based on a reference value that is a reference of the comparison result.

16. The method according to claim 13, wherein the modifying comprises:

modifying the initial calibration coefficient value of the first pixel when a difference between the luminance of the second sub-pixel among the first pixels and the luminance of the second sub-pixel among the second pixels exceeds a preset reference value.

17. The method according to claim 11, wherein the luminance of the second pixel comprises an average value of luminance of a plurality of the second pixels arranged around the first pixel.

18. The method according to claim 11, wherein the controlling comprises:

generating a gate control signal for controlling the display panel based on the modified calibration coefficient value.

19. The method according to claim 11, wherein the modifying comprises:

modifying the initial calibration coefficient value of the first pixel based on the luminance of the second pixel calculated based on the initial calibration coefficient value of the second pixel and measurement data received by a communication circuitry.

20. The method according to claim 19, wherein the measurement data comprises at least one of luminance, chromaticity and sensitivity.

* * * * *